US008683922B2

(12) United States Patent
Isaac et al.

(10) Patent No.: US 8,683,922 B2
(45) Date of Patent: Apr. 1, 2014

(54) CLOSED LOOP INK CONTROL SYSTEM FOR A PRINTING PRESS

(75) Inventors: Ragy Adly Isaac, Oak Brook, IL (US); John Sheridan Richards, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 157 days.

(21) Appl. No.: 13/494,504

(22) Filed: Jun. 12, 2012

(65) Prior Publication Data

US 2013/0327239 A1 Dec. 12, 2013

(51) Int. Cl.
*B41F 31/00* (2006.01)
*B41F 33/00* (2006.01)

(52) U.S. Cl.
USPC ..... 101/365; 101/207; 101/350.1; 101/450.1; 101/484

(58) Field of Classification Search
CPC ..... B41F 31/027; B41F 31/04; B41F 31/045; B41F 33/0045; B41F 33/0027; Y10S 101/47; Y10S 101/45; B41P 2233/51
USPC ..... 101/450.1, 142, 136, 365, 207, 350.1, 101/484
See application file for complete search history.

(56) References Cited

U.S. PATENT DOCUMENTS 4,510,866 A * 4/1985 Sekizawa et al. ..... 101/365
4,852,485 A 8/1989 Brunner
5,027,706 A 7/1991 Niemiro et al.
5,472,324 A 12/1995 Atwater
6,019,040 A 2/2000 Mollers
6,318,260 B1 * 11/2001 Chu et al. ..... 101/365
6,446,555 B1 * 9/2002 Schramm et al. ..... 101/365
7,171,900 B2 2/2007 Niemiro
2006/0130687 A1 6/2006 Weichmann
2006/0162597 A1 7/2006 Momot

FOREIGN PATENT DOCUMENTS

DE 102008041426 A1 2/2010

OTHER PUBLICATIONS

Pritchard, *The Print Guide: The Color Bar*, dated Jul. 7, 2010 http://the-print-guide.blogspot.com/2010/07/color-bar.html (retrieved on Feb. 21, 2012).

* cited by examiner

*Primary Examiner* — Daniel J Colilla
*Assistant Examiner* — Blake A Tankersley
(74) *Attorney, Agent, or Firm* — Davidson, Davidson & Kappel, LLC

(57) ABSTRACT

A method of controlling the ink feed to a printed substrate in a lithographic printing press is provided which includes providing, for each of a plurality of ink zones, an ink coverage requirement for a printing unit of the lithographic printing press; color scanning a first ink zone of a plurality of ink zones on a printed substrate as it exits the printing unit of the lithographic printing press; calculating, for each one of the plurality of ink zones, a dynamic flow change based on the static flow change for said each one of the plurality of ink zones and the ink coverage requirement for said each one of the plurality of ink zones; and providing a flow setting for each one of the plurality of ink zones based on the dynamic flow change for said each one of the plurality of ink zones.

22 Claims, 4 Drawing Sheets

CLOSED LOOP INK CONTROL SYSTEM FOR A PRINTING PRESS

This application relates to the field of printing and in particular to the field of inkers for printing presses.

BACKGROUND INFORMATION

In the field of lithographic printing, ink is continuously conveyed from an ink source through a series of rollers to a printing plate on a plate cylinder in a printing press. Image portions of the printing plate accept ink from one or more of the last of a series of inking rollers and transfer a portion of that ink to a blanket cylinder as a reverse image from which a portion of the ink is transferred to form a correct-reading image on paper or other materials. It is also important in conventional lithographic printing processes that a dampening solution containing water and proprietary additives be conveyed continuously to the printing plate whereby transferring in part to the non-image areas of the printing plate the water functions to keep those non-image areas free of ink. Finally, in conventional printing press systems, the ink is continuously made available in varying amounts determined by cross-press column input control adjustments to a plurality of ink metering devices, such as ink injectors. Open fountain inker systems may also be used as ink metering devices.

Lithographic printing plate surfaces in the absence of imaging materials have minute interstices and a hydrophilic or water-loving property to enhance retention of water, that is the dampening solution, rather than ink on the surface of the plate. Imaging the plate fills these interstices and creates oleophilic or ink-loving areas according to the image that is to be printed. Consequently, when both ink and dampening solution are presented to an imaged plate in appropriate amounts, only the ink tending to reside in non-image areas becomes disbonded from the plate. In general, this action accounts for the continuous ink and dampening solution differentiation on the printing plate surface, which is integral to the lithographic printing process.

It is necessary to control the correct amount of ink supplied from each of the ink injectors during lithographic printing. U.S. Pat. No. 5,027,706, the entire disclosure of which is hereby incorporated by reference, describes an inking system including controls for controlling supply of ink from an ink rail to a plurality of individual ink outlet orifices corresponding to ink columns or zones.

U.S. Pat. No. 5,179,978, the entire disclosure of which is hereby incorporated by reference, describes a rotary ink valve assembly for controlling ink or printing fluid input in a printing press.

U.S. 2006/0162597, the entire disclosure of which is hereby incorporated by reference, describes an integrated ink rail assembly which includes a plurality of page packs, each page pack including a corresponding ink outlet orifice corresponding to an ink column or zone.

BRIEF SUMMARY OF THE INVENTION

In accordance with a first embodiment of the present invention, an offset lithographic printing press includes a printing unit. The printing unit includes a plate cylinder, a blanket cylinder, an inker unit and a dampener unit. The inker unit includes a plurality of ink metering devices, each ink metering device associated with one of a plurality of ink zones of the printing unit. The printing press further includes memory on which is stored ink coverage requirements for each of the plurality of ink zones of the printing unit, a color scanner positioned relative to the printing unit to scan a first ink zone of a plurality of ink zones on a printed substrate as it exits the printing unit, and a controller. The controller is connected to each of the plurality of ink metering devices, to the memory, and to the scanner. The controller is configured to output a flow setting for each one or the plurality of ink zones based on said scanning of the first ink zone of the plurality of ink zones and the ink coverage requirement for said each one of the plurality of ink zones.

In accordance with this embodiment, the controller may be configured to calculate, for each one of the plurality of ink zones, a static initial flow change for said each one of the plurality of ink zones based on said scanning of the first ink zone of the plurality of ink zones and the ink coverage requirement for said each one of the plurality of ink zones; to calculate, for each one of the plurality of ink zones, a dynamic flow change based on the static initial flow change for said each one of the plurality of ink zones and the ink coverage requirement for said each one of the plurality of ink zones; and to output the flow setting for each one of the plurality of ink zones based on the dynamic flow change for said each one of the plurality of ink zones.

In accordance with a second embodiment of the present invention, a method of controlling the ink feed to a printed substrate in a lithographic printing press is provided which includes providing, for each of a plurality of ink zones, an ink coverage requirement for a printing unit of the lithographic printing press; color scanning a first ink zone of a plurality of ink zones on a printed substrate as it exits the printing unit of the lithographic printing press; and providing a flow setting for each one of the plurality of ink zones based on said scanning of the first ink zone of the plurality of ink zones and the ink coverage requirement for said each one of the plurality of ink zones.

In accordance with this embodiment, the step of providing may include calculating, for each one of the plurality of ink zones, a static initial flow change for said each one of the plurality of ink zones based on said scanning of the first ink zone of the plurality of ink zones and the ink coverage requirement for said each one of the plurality of ink zones; calculating, for each one of the plurality of ink zones, a dynamic flow change based on the static flow change for said each one of the plurality of ink zones and the ink coverage requirement for said each one of the plurality of ink zones; and providing the flow setting for each one of the plurality of ink zones based on the dynamic flow change for said each one of the plurality of ink zones.

In accordance with further embodiments of the printing press and method described above, the plurality of ink zones may be a subset of a total number of ink zones on the printed substrate, and an additional color scanner can be used to scan one of a further plurality of ink zones of the printing unit, and the flow setting for each one of the further plurality of ink zones can be based on the scanning of a first ink zone of the further plurality of ink zones and the ink coverage requirement for said each one of the further plurality of ink zones. This embodiment may further include, for each one of the further plurality of ink zones, calculating a static initial flow change for said each one of the further plurality of ink zones based on said scanning of the first ink zone of the further plurality of ink zones and the ink coverage requirement for said each one of the further plurality of ink zones; for each one of the further plurality of ink zones, calculating a dynamic flow change based on the static initial flow change for said each one of the further plurality of ink zones and the ink coverage requirement for said each one of the further plurality of ink zones; and providing the flow setting for each one of the further plurality of ink zones based on the dynamic flow change for said each one of the further plurality of ink zones.

In accordance with other embodiments of the printing press and method described above, the printing press may include a second printing unit with a second plurality of ink zones, and the second plurality of ink zones may be controlled either from the color scanner discussed above or a second color scanner.

If the second plurality of ink zones are controlled by the color scanner, then the method or printing press may include, for each one of the second plurality of ink zones of the second printing unit, a static initial flow change for said each one of the second plurality of ink zones of the second printing unit is based on said scanning of the first ink zone of the plurality of ink zones of the printing unit and the ink coverage requirement for said each one of the second plurality of ink zones of the second printing unit; for each one of the second plurality of ink zones of the second printing unit, a dynamic flow change is calculated based on the static initial flow change for said each one of the second plurality of ink zones of the second printing unit and the ink coverage requirement for said each one of the second plurality of ink zones of the second printing unit; and a flow setting for each one of the second plurality of ink zones of the second printing unit is provided based on the dynamic flow change for said each one of the second plurality of ink zones of the second printing unit.

If the second plurality of ink zones are controlled by the second color scanner, then the method or printing press may include for each one of the second plurality of ink zones of the second printing unit, a static initial flow change for said each one of the second plurality of ink zones is calculated based on said scanning of the first ink zone of the second plurality of ink zones of the second printing unit and the ink coverage requirement for said each one of the second plurality of ink zones of the second printing unit; for each one of the second plurality of ink zones of the second printing unit, a dynamic flow change is calculated based on the static initial flow change for said each one of the second plurality of ink zones of the second printing unit and the ink coverage requirement for said each one of the second plurality of ink zones of the second printing unit; and a flow setting for each one of the second plurality of ink zones of the second printing unit is provided based on the dynamic flow change for said each one of the second plurality of ink zones of the second printing unit

BRIEF DESCRIPTION OF THE DRAWINGS

The present invention will be further described with respect the following Figures, in which.

DETAILED DESCRIPTION OF PREFERRED EMBODIMENTS OF THE INVENTION

Figure 1A:
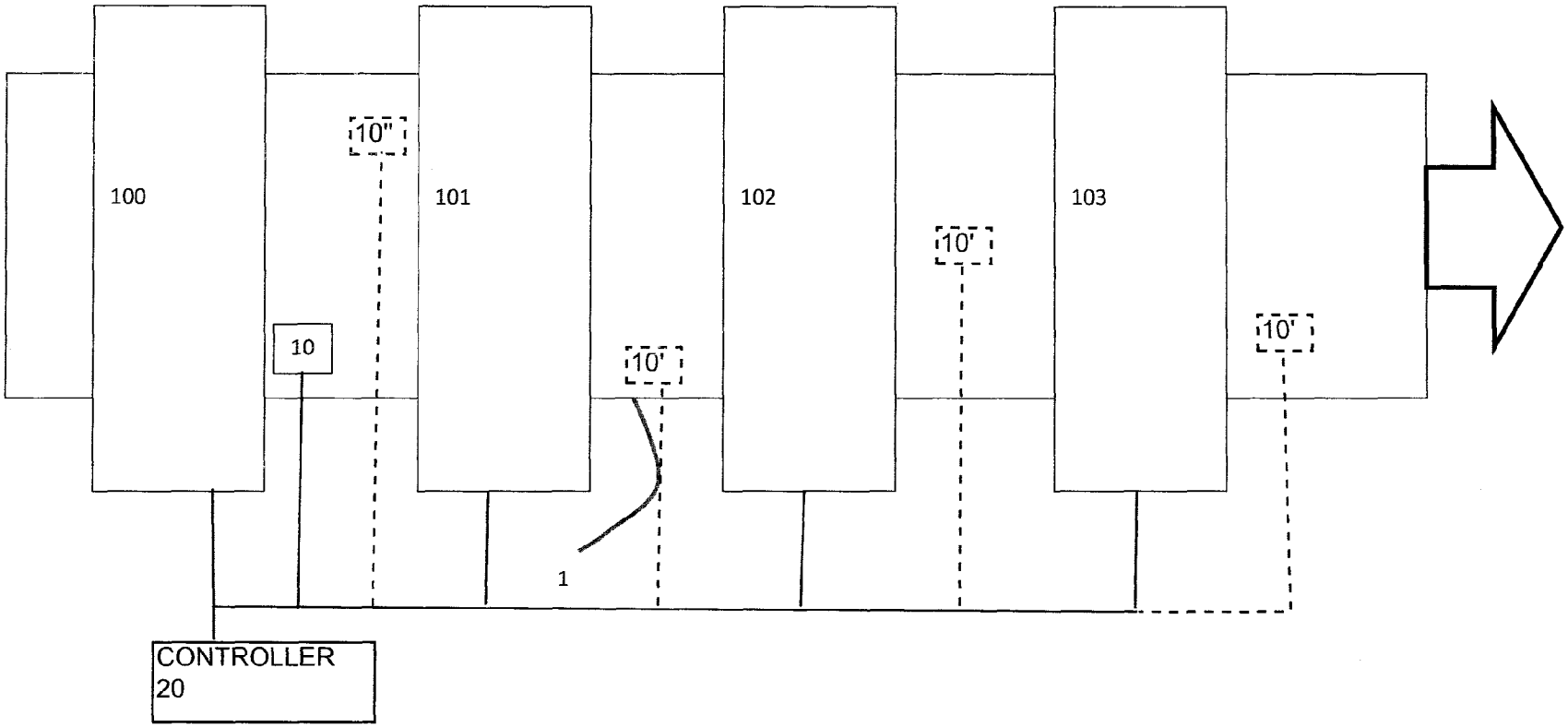
FIG. 1*a* shows a top view of printing press including four printing units printing on a web with a scanner positioned over the web after the first printing unit, along with optional further scanners illustrated in phantom (dashes).

As one of ordinary skill in the art will appreciate, inkers typically include a plurality of ink metering devices which feed ink to respective ink key zones or columns across a printed substrate such as a web or sheet. Each metering device is individually controlled to provide a desired ink coverage for its respective zone. The desired ink coverage for each zone is specified from prepress for a given print job. In conventional closed loop ink feed control systems, the actual printed colors in each ink zone are sampled and the sampled values are used to control the ink feed to control their respective zones. This requires either separate color scanners for each ink zone, at significant expense, or movable color scanners that are moved to each ink zone, which causes delays in sample data, and increases the complexity of the system.

In accordance with an embodiment of the present invention, ink film thickness can be controlled in multiple ink key zones using color readings scanned from a few or even one equivalent printed area (such as an ink zone). In particular, the system uses (a) known coverage requirements for each ink key zone (from prepress), with (b) scanned printed color readings from as few as one equivalent printed area, using (c) the known settings of the individual ink zone values, and (d) the variance-covariance matrix (or for short covariance matrix) which captures the variance and linear correlation in multivariate/multidimensional data across multiple ink zones of the particular inking system initially concluded from on-press testing and fine-tuned with running production data. Reading as few as one equivalent area could be in a dedicated color bar printed on the web, or from the actual printed image itself.

In this regard, for a given press inking system, a covariance matrix is determined by on-press testing and fine-tuned with running production data. This provides the natural variability and co-variability between the various inking zones. The covariance matrix provides measurements' reliability under various conditions such as multiple coverage percentages and with a variety of paper types.

Using this knowledge of the ink coverage variability, it is possible to control ink film thickness in multiple ink key zones using color readings scanned from a few or even one ink zone. In this regard, the level difference between the scanned color reading from a scanned ink key zone and the desired color value for that selected ink key zone is used as an indicator of the change required to the ink key that controls color for the scanned ink zone as is known in the art. However, this level difference is also used to calculate the equivalent change that will be required for each of the ink key zones not scanned, relying on the predictability model for each ink zone to achieve the required color changes without the need to take color readings for these ink key zones. This method is not limited to static adjustments, but can also be utilized to make dynamic changes to ink flow settings to compensate for ink train delays, as is well-known in the current state of the art of ink control in offset presses.

A representative system includes one or more color scanners in a fixed lateral position above each web surface so that only a subset of the ink key zones for the web surface are scanned. In a one-web perfecting press, this would for example comprise at least two color measuring devices or scanners—one for one surface of the web, and one for the opposite surface of the web. Preferably, each color scanner scans a single ink key zone. In one embodiment, a single scanner is used to scan a single zone of a web surface, and the remaining zones have no scanners. In other embodiments, 20%, 40%, 50%, or 60% of the ink zones can have associated scanners.

Figure 1B:
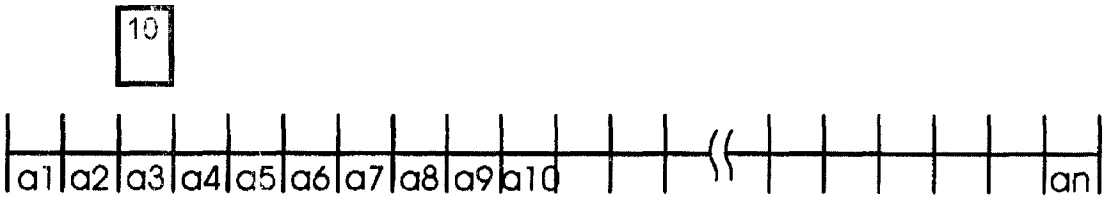
FIG. 1*b* shows a row of ink zones "a1" to "an" across a web with a scanner positioned to scan zone "a3".

FIG. 1*a* illustrates a top view of an offset lithographic printing press in accordance with an embodiment of the present invention including four printing units 101, 102, 103, 104 printing four colors on a web 1. Also illustrated is a scanner 10 positioned after printing unit 101, over web 1. As discussed below, there can be additional scanners (shown in dashes as $10^1$) positioned after printing units 102, 103, and 104. Further, there can be more than one scanner (shown in dashes as $10^{11}$) positioned after each printing unit. FIG. 1*b* shows a row of ink zones "a1" to "an" across a web and the scanner 10 positioned over ink zone "a3". As one of ordinary skill in the art will appreciate, each printing unit of an offset lithographic printing press includes an inker unit, a dampener unit, a plate cylinder, a blanket cylinder, and an impression cylinder. In a perfecting offset lithographic printing press there would be two inker units, two dampener units, two plate cylinders, and two opposing blanket cylinders. Also illustrated in FIG. 1*a* is a controller 20 which controls the printing units 101-104, including the inker units, and is connected to the scanner 10. The controller 20 further includes software and/or hardware to implement the closed loop control algorithms discussed below in connection with FIG. 3. It may also serve as part of a planning computer or console having coverage requirements for each ink zone stored in memory thereon.

Figure 2A:
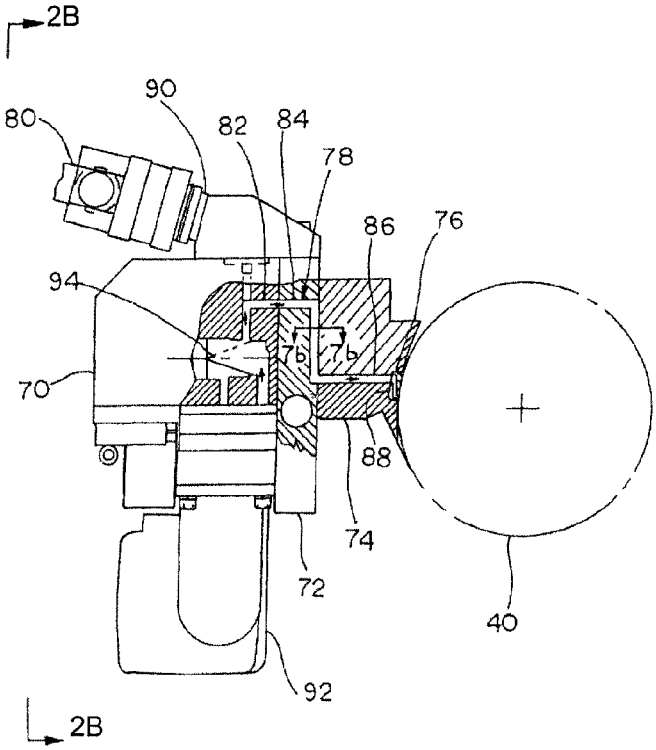
FIGURE 2A (PRIOR ART)
FIGS. 2A and 2B show a prior art ink rail assembly which includes a page pack.

FIG. 2A shows a prior art ink rail assembly 36 which includes a page pack 70 that is mounted in fluid communication to a manifold 72 that is in turn mounted in fluid communication to an ink rail 74. An orifice rail 76 is mounted in fluid communication to the ink rail 78. The page pack 70, manifold 72, ink rail 74 and orifice rail 76 together define an overall ink passage 78 for transferring ink from a supply conduit 80 and delivering it to the drum 40. The page pack 70, the manifold 72, the ink rail 74, and the orifice rail 76 each individually include ink paths 82, 84, 86, and 88 respectively. A ink rail assembly 36 is provided in each inker unit of each of the printing units 101, 102, 103, 104.

The page pack 70 includes an ink inlet 90 operatively connected to an ink supply (not shown) via the supply conduit 80. A pump 92 pulls the ink from the supply conduit 80 through the ink passage 78 and through a valve 94 which regulates the supply of ink.

The pump 92 then pushes the ink along the ink passage 78 through the manifold 72, ink rail 74, and orifice rail 76 and out to the drum 40. As is known, the ink is applied to the drum 40, from where the ink is ultimately transferred through a series of intermediate transfer drums to a plate cylinder and then a web as is known. As one of skill in the art will appreciate, each page pack can apply ink to a different zone "an."

Figure 2B:
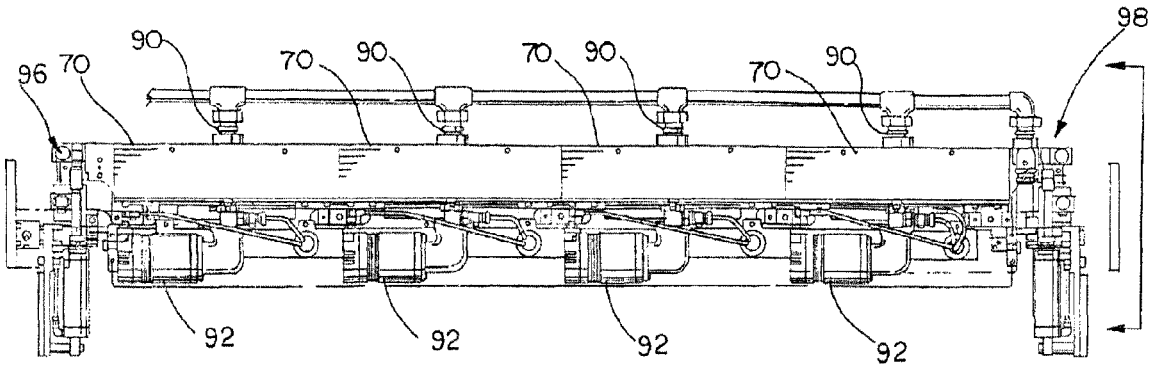
FIGURE 2B (PRIOR ART)

Referring now to FIG. 2B, the ink rail assembly 36 is shown taken along line 2B-2B of FIG. 2A. The ink rail assembly 36 preferably includes a number of modular page packs 70, with four such page packs 70 shown in FIG. 2B. The page packs 70 can be those as described in detail in U.S. Pat. No. 5,472,324. As such, each page pack 70 can be approximately 12½" wide, such that the four page packs 70 can print a web of about 50".

The ink rail assembly 36 includes a first end 96, a second end 98, and a middle 99. The page packs 70 are mounted to the manifold 72, and extend along the length of the ink rail assembly 36 between the first end 96 and the second end 98. All of the page packs 70 may be secured directly to the manifold 72 via bolts. Each page pack 70 receives the ink via the ink inlet 90 and delivers the ink directly to the manifold 72 via several smaller outlets (not shown).

It will be noted that each such page pack 70 includes its own pump/motor 92, ink inlet 90, and valve 94 (See FIG. 2A). Each of the individual ink inlets 90 may be connected to a single supply conduit 80 as is shown in FIG. 2B.

It will be further understood that, depending on the dimensions for the contemplated application, additional or fewer modular page packs 70 may be employed as necessary. Thus, if a change is required such that a smaller web is used, a page pack 70 may be deactivated such that ink is not delivered to locations outside the web.

While in this example a specific page pack 70 is shown, it is clear that any device that receives ink from a supply and controllably delivers it to an ink rail 74 to be applied to an ink zone could be used as a page pack. Further, although page packs are particularly efficient for delivering ink to ink zones, other types of ink injectors may also be used, provided that they allow the ink supply to different zones to be separately controlled. Further, other types of ink metering devices other than ink injectors could be used. For example, an open fountain inking system could be employed.

It should be noted that the manner in which a controller, such as controller 20 can be configured to control the supply of ink to different ink zones is well known in the art and therefore will not be recounted herein. Rather, the embodiments of the present invention are directed to a novel closed loop control system. In this regard, controller 20 can, for example, be one or more programmable logic controller(s) (PLC), or any suitable hardware based or software based electronic controller or controllers including, for example, one or more microcomputers with related support circuitry, one or more finite static machine(s), one or more field programmable gate array(s), FPGA, or one or more application-specific integrated circuit(s), ASIC, among others.

Figure 3:
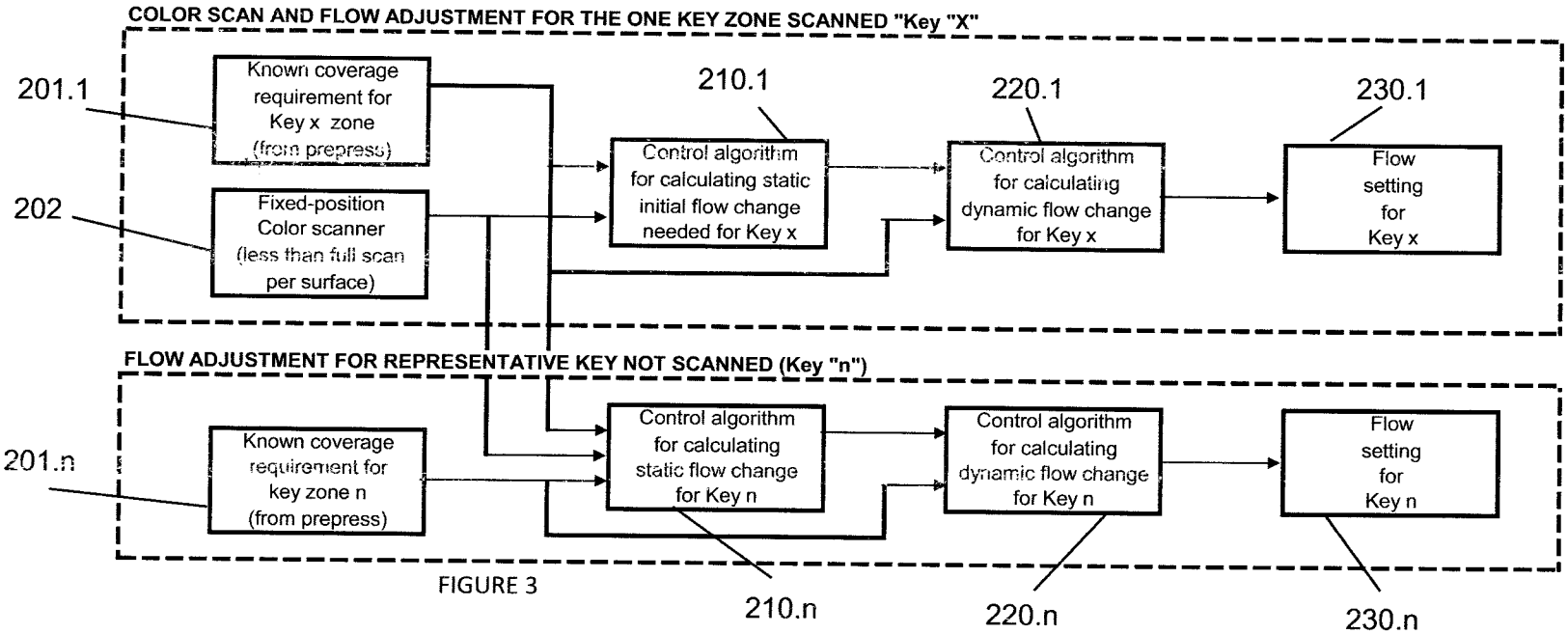
FIG. 3 illustrates a control system and method for closed-loop control of multiple ink key zones using scanned printed color readings from less than a full zone scan.

FIG. 3 shows the general flow of the method and control system algorithms of controller 20 for providing closed loop control of ink fed to individual zones across a printed substrate. This system and method provides closed-loop control of multiple ink key zones using scanned printed color readings from less than full zone scan. One ink key zone (designated Key 0) has its printed color measuring device by a fixed-position or movable color measuring device. Using conventional techniques well known to those of ordinary skill in the art, the flow from the corresponding flow control mechanism is adjusted dynamically to achieve a new color setting at the soonest possible time, and then adjusted to the static value necessary to maintain the desired color until the next sampling.

Referring to FIG. 3, the flow setting 230.1 for an ink zone or key x is a function of a dynamic flow change algorithm 220.1 and static initial flow change algorithm 210.1 as is known in the art. The static initial flow change algorithm 210.1 uses the known coverage requirements for Key x from prepress and data from a color scan of the image printed on the web to calculate a static initial flow change needed for Key x. Then the dynamic flow change algorithm dynamically changes the flow setting for Key x over time to achieve the flow change specified by the static initial flow change algorithm based on the output of the static initial flow change algorithm 210.1 and the known coverage requirements 201.1 from prepress. This static initial flow change from 210.1 is used until the system samples the data from the scanner 202 again, and the process is repeated. As noted above, in prior art systems, each zone needs to be scanned and controlled separately in the same manner.

In accordance with the closed loop control method according to the present invention, color scan data from one zone (Key x) is used to adjust not only the flow setting for zone Key x, but also the settings for a plurality of other zones key n which have not been scanned. In accordance with the present invention, adjustments are made to other key zones not scanned (represented by Key n in FIG. 1), by relying on the principle that a calculatable adjustment to all the non-scanned keys will be needed, and that the adjustments can be calculated based on the adjustment needed to Key 0, the coverage requirement for key 0, and the coverage requirement of the non-scanned key zone n. In embodiments where a single ink zone is scanned, the adjustment is made to all of the other key zones not scanned based on the scanned ink zone. If more than one scanner is used, then the data from each scanner would be used to adjust a subset of the unscanned zones. For example, referring to FIG. 1, scanner $\mathbf{10}^1$ could be used to scan ink zone key 0 in printing unit 100. This scan could be used to control all the ink zones in printing units 100, 101, 102, 103, and 104. Alternatively, each printing unit could have an associated scanner $\mathbf{10}^1$ for controlling ink supply to its ink zones; or two scanners 10, $\mathbf{10}^{11}$ could be used to each control the ink supply to a subset of zones in a single printing unit. Referring to FIG. 3, static flow change algorithm 210.*n* for Key "n" calculates a static flow change for Key n from the known coverage requirements for key zone n (201.*n*) and the color scan of ink key zone x (202). Dynamic flow change algorithm 220.1 dynamically changes the flow setting (230.*n*) for key zone n over time by calculating the dynamic flow change for Key zone n from the output of static flow change algorithm 210.*n* and known coverage requirements for key zone n (201.*n*).

Using this method and control system, variables that are inherent throughout a job (such as paper coloration and density) can be compensated for without resorting to individual printed color measurements of every ink key zone.

In accordance with a further embodiment, the scanned zone or zones can be used to control unscanned ink zones of other printed substrates in other offset lithographic printing presses. For example, in the case of multiple webs of paper having the same coloration, a scanned zone or zones from one web could be used to control ink feed of a plurality of webs. Thus, in the context of FIG. 3, in this embodiment Key N could include not only zones in the web scanned by Key 0, but also all of the zones in other webs having, for example, the same coloration and/or density. In this manner, the system uses the scan of Key 0, to calculating needed adjustments for variables inherent throughout the job on multiple webs of paper.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of controlling the ink feed to a printed substrate in a lithographic printing press, comprising:

providing, for each of a plurality of ink zones of a printing unit, an ink coverage requirement for the printing unit of the lithographic printing press;

color scanning a portion of a printed substrate printed by a first ink zone of the plurality of ink zones of the printing unit as it exits the printing unit of the lithographic printing press; and providing a flow setting for each one of the plurality of ink zones based on said scanning of the portion of the printed substrate printed by the first ink zone of the plurality of ink zones and the ink coverage requirement for said each one of the plurality of ink zones, wherein portions of the printed substrate printed by the remaining ink zones of the plurality of ink zones other than the first ink zone are not color scanned, and wherein the flow settings for the remaining ink zones are based on said scanning of the portion of the printed substrate printed by the first ink zone and the ink coverage requirement for said each one of the plurality of ink zones.

2. The method of claim 1, wherein the step of providing further includes:

calculating, for each one of the plurality of ink zones, a static initial flow change for said each one of the plurality of ink zones based on said scanning of the portion of the printed substrate printed by the first ink zone of the plurality of ink zones and the ink coverage requirement for said each one of the plurality of ink zones;

calculating, for each one of the plurality of ink zones, a dynamic flow change based on the static flow change for said each one of the plurality of ink zones and the ink coverage requirement for said each one of the plurality of ink zones; and providing the flow setting for each one of the plurality of ink zones based on the dynamic flow change for said each one of the plurality of ink zones.

3. The method of claim 2, wherein, for each one of the plurality of ink zones, the dynamic flow change is based solely on the static initial flow change for said each one of the plurality of ink zones and the ink coverage requirement for said each one of the plurality of ink zones.

4. The method of claim 3, wherein, for each one of the plurality of ink zones, the static initial flow change for said each one of the plurality of ink zones is based solely on said scanning of the portion of the printed substrate printed by the first ink zone and the ink coverage requirement for said each one of the plurality of ink zones.

5. The method of claim 2, wherein the plurality of ink zones are a subset of a total number of ink zones of the printing unit.

6. The method of claim 5, wherein the total number of ink zones of the printing unit includes the plurality of ink zones and a further plurality of ink zones, and wherein the method further comprises:

providing, for each of the further plurality of ink zones, an ink coverage requirement for the printing unit of the lithographic printing press;

color scanning a portion of the printed substrate printed by a first ink zone of the further plurality of ink zones as it exits the printing unit of the lithographic printing press;

calculating, for each one of the further plurality of ink zones, a static initial flow change for said each one of the further plurality of ink zones based on said scanning of the portion of the printed substrate printed by the first ink zone of the further plurality of ink zones and the ink coverage requirement for said each one of the further plurality of ink zones;

calculating, for each one of the further plurality of ink zones, a dynamic flow change based on the static initial flow change for said each one of the further plurality of ink zones and the ink coverage requirement for said each one of the further plurality of ink zones; and providing a flow setting for each one of the further plurality of ink zones based on the dynamic flow change for said each one of the further plurality of ink zones.

7. The method of claim 2, further comprising:

providing, for each of a second plurality of ink zones of a second printing unit of the lithographic printing press, an ink coverage requirement for the second printing unit, the second printing unit printing a different color than the printing unit;

calculating, for each one of the second plurality of ink zones of the second printing unit, a static initial flow change for said each one of the second plurality of ink zones of the second printing unit based on said scanning of the portion of the printed substrate printed by the first ink zone of the plurality of ink zones of the printing unit and the ink coverage requirement for said each one of the second plurality of ink zones of the second printing unit;

calculating, for each one of the second plurality of ink zones of the second printing unit, a dynamic flow change based on the static initial flow change for said each one of the second plurality of ink zones of the second printing unit and the ink coverage requirement for said each one of the second plurality of ink zones of the second printing unit; and providing a flow setting for each one of the second plurality of ink zones of the second printing unit based on the dynamic flow change for said each one of the second plurality of ink zones of the second printing unit.

8. The method of claim 2, wherein the method further comprises:

providing, for each of a second plurality of ink zones of a second printing unit of the lithographic printing press, an ink coverage requirement for the second printing unit of the lithographic printing press;

color scanning a portion of the printed substrate printed by a first ink zone of the second plurality of ink zones of the second printing unit as it exits the second printing unit of the lithographic printing press;

calculating, for each one of the second plurality of ink zones of the second printing unit, a static initial flow change for said each one of the second plurality of ink zones based on said scanning of the portion of the printed substrate printed by the first ink zone of the second plurality of ink zones of the second printing unit and the ink coverage requirement for said each one of the second plurality of ink zones of the second printing unit;

calculating, for each one of the second plurality of ink zones of the second printing unit, a dynamic flow change based on the static initial flow change for said each one of the second plurality of ink zones of the second printing unit and the ink coverage requirement for said each one of the second plurality of ink zones of the second printing unit; and providing a flow setting for each one of the second plurality of ink zones of the second printing unit based on the dynamic flow change for said each one of the second plurality of ink zones of the second printing unit.

9. An offset lithographic printing press, comprising:

a printing unit including a plate cylinder, a blanket cylinder, an inker unit and a dampener unit, the inker unit including a plurality of ink metering devices, each ink metering device associated with one of a plurality of ink zones of the printing unit;

memory on which is stored ink coverage requirements for each of the plurality of ink zones of the printing unit;

a color scanner positioned relative to the printing unit to scan a portion of a printed substrate printed by a first ink zone of the plurality of ink zones as it exits the printing unit;

a controller, the controller connected to each of the plurality of ink metering devices, to the memory, and to the scanner, the controller configured to output a flow setting for each one of the plurality of ink zones based on said scanning of the portion of the printed substrate printed by the first ink zone of the plurality of ink zones and the ink coverage requirement for said each one of the plurality of ink zones, wherein the color scanner does not scan the remaining portions of the printed substrate printed by ink zones of the plurality of ink zones other than the first ink zone, and wherein the flow settings for the remaining ink zones are based on said scanning of the portion of the printed substrate printed by the first ink zone and the ink coverage requirement for said each one of the plurality of ink zones.

10. The offset lithographic printing press according to claim 9, wherein the controller configured to calculate, for each one of the plurality of ink zones, a static initial flow change for said each one of the plurality of ink zones based on said scanning of the portion of the printed substrate printed by the first ink zone of the plurality of ink zones and the ink coverage requirement for said each one of the plurality of ink zones, the controller configured to calculate, for each one of the plurality of ink zones, a dynamic flow change based on the static initial flow change for said each one of the plurality of ink zones and the ink coverage requirement for said each one of the plurality of ink zones; and the controller configured to output the flow setting for each one of the plurality of ink zones based on the dynamic flow change for said each one of the plurality of ink zones.

11. The offset lithographic printing press of claim 10, wherein the controller is a computer.

12. The offset lithographic printing press of claim 11, wherein the controller is an application specific integrated circuit.

13. The offset lithographic printing press of claim 10, wherein the controller is a component of a planning computer and the planning computer includes the memory.

14. The offset lithographic printing press of claim 10, further comprising a planning computer, the planning computer includes the memory.

15. The offset lithographic printing press of claim 10, wherein, for each one of the plurality of ink zones, the dynamic flow change is based solely on the static initial flow change for said each one of the plurality of ink zones and the ink coverage requirement for said each one of the plurality of ink zones.

16. The offset lithographic printing press of claim 14, wherein, for each one of the plurality of ink zones, the static initial flow change for said each one of the plurality of ink zones is based solely on said scanning of the portion of the printed substrate printed by the first ink zone and the ink coverage requirement for said each one of the plurality of ink zones.

17. The method of claim 2, wherein the plurality of ink zones are a subset of a total number of ink zones of the printing unit.

18. The offset lithographic printing press of claim 10, comprising:

a second printing unit including a plate cylinder, a blanket cylinder, an inker unit and a dampener unit, the inker unit of the second printing unit including a plurality of ink metering devices, each ink metering device associated with one of a second plurality of ink zones of the second printing unit;

a second color scanner positioned relative to the second printing unit to scan a portion of the printed substrate printed by a first ink zone of the second plurality of ink zones as it exits the second printing unit;

wherein the memory stores ink coverage requirements for each of the second plurality of ink zones of the printing unit; and wherein the controller is connected to each of the second plurality of ink metering devices and to the second scanner, the controller configured to calculate, for each one of the second plurality of ink zones, a static initial flow change for said each one of the second plurality of ink zones based on said scanning of the portion of the printed substrate printed by the first ink zone of the second plurality of ink zones and the ink coverage requirement for said each one of the second plurality of ink zones, the controller configured to calculate, for each one of the second plurality of ink zones, a dynamic flow change based on the static initial flow change for said each one of the second plurality of ink zones and the ink coverage requirement for said each one of the second plurality of ink zones; and the controller configured to output a flow setting for each one of the second plurality of ink zones based on the dynamic flow change for said each one of the second plurality of ink zones.

19. The offset lithographic printing press of claim 10, comprising:

a second printing unit including a plate cylinder, a blanket cylinder, an inker unit and a dampener unit, the inker unit of the second printing unit including a plurality of ink metering devices, each ink metering device associated with one of a second plurality of ink zones of the second printing unit;

a second scanner positioned relative to the second printing unit to scan a portion of the printed substrate printed by a first ink zone of the second plurality of ink zones on the printed substrate as it exits the second printing unit;

wherein the memory stores ink coverage requirements for each of the second plurality of ink metering device of the printing unit; and a second controller, the second controller connected to each of the second plurality of ink metering devices, to the console, and to the second scanner, the second controller configured to calculate, for each one of the second plurality of ink zones, a static initial flow change for said each one of the second plurality of ink zones based on said scanning of the portion of the printed substrate printed by the first ink zone of the second plurality of ink zones and the ink coverage requirement for said each one of the second plurality of ink zones, the second controller configured to calculate, for each one of the second plurality of ink zones, a dynamic flow change based on the static initial flow change for said each one of the second plurality of ink zones and the ink coverage requirement for said each one of the second plurality of ink zones; and the second controller configured to output a flow setting for each one of the second plurality of ink zones based on the dynamic flow change for said each one of the second plurality of ink zones.

20. The offset lithographic printing press of claim 17, wherein the total number of ink zones of the printing unit includes the plurality of ink zones and a further plurality of ink zones, the offset lithographic printing unit including a further color scanner, the further scanner positioned relative to the printing unit to scan a portion of the printed substrate printed by a first ink zone of the further plurality of ink zones as it exits the printing unit;

wherein the inker unit includes a further plurality of ink metering devices, each of the further plurality of ink metering devices associated with one of the further plurality of ink zones of the printing unit;

wherein the memory stores ink coverage requirements for each of the further plurality of ink zones of the printing unit;

wherein the controller is configured to calculate, for each one of the further plurality of ink zones, a static initial flow change for said each one of the further plurality of ink zones based on said scanning of the portion of the printed substrate printed by the first ink zone of the further plurality of ink zones and the ink coverage requirement for said each one of the further plurality of ink zones, the controller configured to calculate, for each one of the further plurality of ink zones, a dynamic flow change based on the static initial flow change for said each one of the further plurality of ink zones and the ink coverage requirement for said each one of the further plurality of ink zones, and the controller configured to output a flow setting for each one of the further plurality of ink zones based on the dynamic flow change for said each one of the further plurality of ink zones.

21. The offset lithographic printing press of claim 10, further comprising:

a second printing unit including a plate cylinder, a blanket cylinder, an inker unit and a dampener unit, the inker unit of the second printing unit including a second plurality of ink metering devices, each ink metering device associated with one of a second plurality of ink zones of the second printing unit;

the memory storing ink coverage requirements for each of the second plurality of ink zones of the printing unit; and wherein the controller is connected to each of the second plurality of ink metering devices, the controller configured to calculate for each one of the second plurality of ink zones of the second printing unit, a static initial flow change for said each one of the second plurality of ink zones of the second printing unit based on said scanning of the portion of the printed substrate printed by the first ink zone of the plurality of ink zones of the printing unit and the ink coverage requirement for said each one of the second plurality of ink zones of the second printing unit, the controller configured to calculate, for each one of the second plurality of ink zones of the second printing unit, a dynamic flow change based on the static initial flow change for said each one of the second plurality of ink zones of the second printing unit and the ink coverage requirement for said each one of the second plurality of ink zones of the second printing unit; and the controller configured to output a flow setting for each one of the second plurality of ink zones of the second printing unit based on the dynamic flow change for said each one of the second plurality of ink zones of the second printing unit.

22. A method of controlling the ink feed to a printed substrate in a lithographic printing press, and a second printed substrate in a second lithographic printing press, comprising:

controlling the ink feed to the printed substrate in the lithographic printing press in accordance with the method of claim 2; and controlling the ink feed to the second printed substrate in the second lithographic printing press, said step of controlling including the steps of:

providing, for each of a second plurality of ink zones of a second printing unit of the second lithographic printing press, an ink coverage requirement for the second printing unit;

calculating, for each one of the second plurality of ink zones of the second printing unit, a static initial flow change for said each one of the second plurality of ink zones of the second printing unit based on said scanning of the portion of the printed substrate printed by the first ink zone of the plurality of ink zones of the printing unit and the ink coverage requirement for said each one of the second plurality of ink zones of the second printing unit;

calculating, for each one of the second plurality of ink zones of the second printing unit, a dynamic flow change based on the static initial flow change for said each one of the second plurality of ink zones of the second printing unit and the ink coverage requirement for said each one of the second plurality of ink zones of the second printing unit, and providing a flow setting for each one of the second plurality of ink zones of the second printing unit based on the dynamic flow change for said each one of the second plurality of ink zones of the second printing unit.

* * * * *